US006067519A

United States Patent [19]

Lowry

[11] Patent Number: 6,067,519

[45] **Date of Patent: *May 23, 2000**

[54] WAVEFORM SPEECH SYNTHESIS

[75] Inventor: Andrew Lowry, Ipswich, United Kingdom

[73] Assignee: British Telecommunications public limited company, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,206

[22] PCT Filed: Apr. 3, 1996

[86] PCT No.: PCT/GB96/00817

§ 371 Date: Nov. 7, 1996

§ 102(e) Date: Nov. 7, 1996

[87] PCT Pub. No.: WO96/32711

PCT Pub. Date: Oct. 17, 1996

[30] Foreign Application Priority Data

Apr. 12, 1995 [EP] European Pat. Off. ..... 95302474

[51] Int. Cl.[7] ..... G10L 13/06

[52] U.S. Cl. ..... 704/264; 704/267; 704/268

[58] Field of Search ..... 704/264, 268, 704/254, 267, 258, 261, 265

[56] References Cited

U.S. PATENT DOCUMENTS

| | | | |
|---|---|---|---|
| 4,802,224 | 1/1989 | Shiraki et al. | 704/245 |
| 4,820,059 | 4/1989 | Miller et al. | 704/254 |
| 5,175,769 | 12/1992 | Hejna, Jr. et al. | 704/211 |
| 5,524,172 | 6/1996 | Hamon | 704/268 |
| 5,617,507 | 4/1997 | Lee et al. | 704/200 |
| 5,787,398 | 7/1998 | Lowry | 704/268 |
| 5,978,764 | 11/1999 | Lowry et al. | 704/258 |

FOREIGN PATENT DOCUMENTS

WO 94/17517 8/1994 WIPO .

OTHER PUBLICATIONS

Hirokawa et al, "High Quality Speech Synthesis System Based on Waveform Concatenation of Phoneme Segment", IEICE Transactions on Fundamentals of Electronics, Communications and Computer Sciences, vol. 76A, No. 11, Nov. 1993, Tokyo, pp. 1964–1970, XP002009059.

Shadle et al, "Speech Sythesis by Linear Interpolation of Spectral Parameters Between Dyad Boundaries", The Journal of the Acoustical Society of America, vol. 66, No. 5, Nov. 1979, New York, pp. 1325–1332, XP002009060.

*Primary Examiner*—David R. Hudspeth
*Assistant Examiner*—Martin Lerner
*Attorney, Agent, or Firm*—Nixon & Vanderhye P.C.

[57] ABSTRACT

Portions of spoon waveform are joined by forming extrapolations at the end of one and the beginning of the next portion to create an overlap region with synchronous pitchmarks, and then forming a weighted sum across the overlap to provide a smooth transition.

11 Claims, 4 Drawing Sheets

WAVEFORM SPEECH SYNTHESIS

BACKGROUND OF THE INVENTION

Field of the Invention

The present invention relates to speech synthesis, and is particularly concerned with speech synthesis in which stored segments of digitised waveforms are retrieved and combined.

SUMMARY OF THE INVENTION

According to the present invention there is provided a method of speech synthesis comprising the steps of:

retrieving a first sequence of digital samples corresponding to a first desired speech waveform and first pitch data defining excitation instants of the waveform;

retrieving a second sequence of digital samples corresponding to a second desired speech waveform and second pitch data defining excitation instants of the second waveform;

forming an overlap region by synthesising from at least one sequence an extension sequence, the extension sequence being pitch adjusted to be synchronous with the excitation instants of the respective other sequence;

forming for the overlap region weighted sums of samples of the original sequence(s) and samples of the extension sequence(s).

In another aspect of the invention provides an apparatus for speech synthesis comprising the steps of:

means storing sequences of digital samples corresponding to portions of speech waveform and pitch data defining excitation instants of those waveforms;

control means controllable to retrieve from the store means 1 sequences of digital samples corresponding to desired portions of speech waveform and the corresponding pitch data defining excitation instants of the waveform;

means for joining the retrieved sequences, the joining means being arranged in operation (a) to synthesise from at least the first of a pair of retrieved sequences an extension sequence to extend that sequence into an overlap region with the other sequence of the pair, the extension sequence being pitch adjusted to be synchronous with the excitation instants of that other sequence and (b) to form for the overlap region weighted sum of samples of the original sequence(s) and samples of the extension sequence(s).

Other aspects of the invention are defined in the subclaims.

BRIEF DESCRIPTION OF THE DRAWING

Some embodiments of the invention will now be described, by way of example, with reference to the accompanying drawings, in which.

DETAILED DESCRIPTION OF EXEMPLARY EMBODIMENTS

Figure 1:
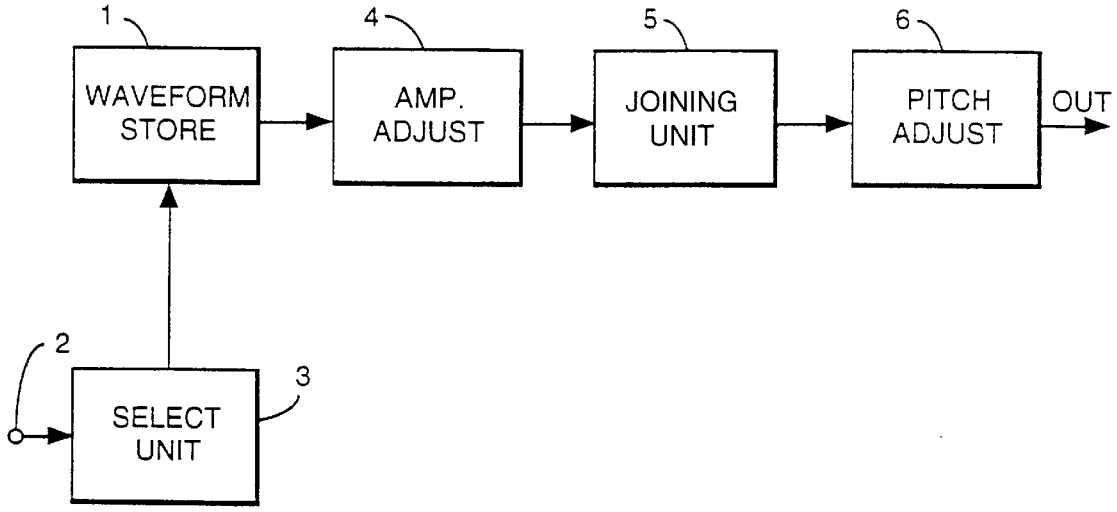
FIG. 1 is a block diagram of one form of speech synthesiser in accordance with the invention.

In the speech synthesiser of FIG. 1, a store 1 contains speech waveform sections generated from a digitised passage of speech, originally recorded by a human speaker reading a passage (of perhaps 200 sentences) selected to contain all possible (or at least, a wide selection of) different sounds. Thus each entry in the waveform store 1 comprises digital samples of a portion of speech corresponding to one or more phonemes, with marker information indicating the boundaries between the phonemes. Accompanying each section is stored data defining "pitchmarks" indicative of points of glottal closure in the signal, generated in conventional manner during the original recording.

An input signal representing speech to be synthesised, in the form of a phonetic representation, is supplied to an input 2. This input may if wished be generated from a text input by conventional means (not shown). This input is processed in known manner by a selection unit 3 which determines, for each unit of the input, the addresses in the store 1 of a stored waveform section corresponding to the sound represented by the unit. The unit may, as mentioned above, be a phoneme, diphone, triphone or other sub-word unit, and in general the length of a unit may vary according to the availability in the waveform store of a corresponding waveform section. Where possible, it is preferred to select a unit which overlaps a preceding unit by one phoneme. Techniques for achieving this are described in our CO-pending International patent application no. PCT/GB/9401688 and U.S. patent application Ser. No. 166,988 of 16 Dec. 1993.

The units, once read out, are each individually subjected to an amplitude normalisation process in an amplitude adjustment unit 4 whose operation is described in our co-pending European patent application no. 95301478.4.

Figure 2:
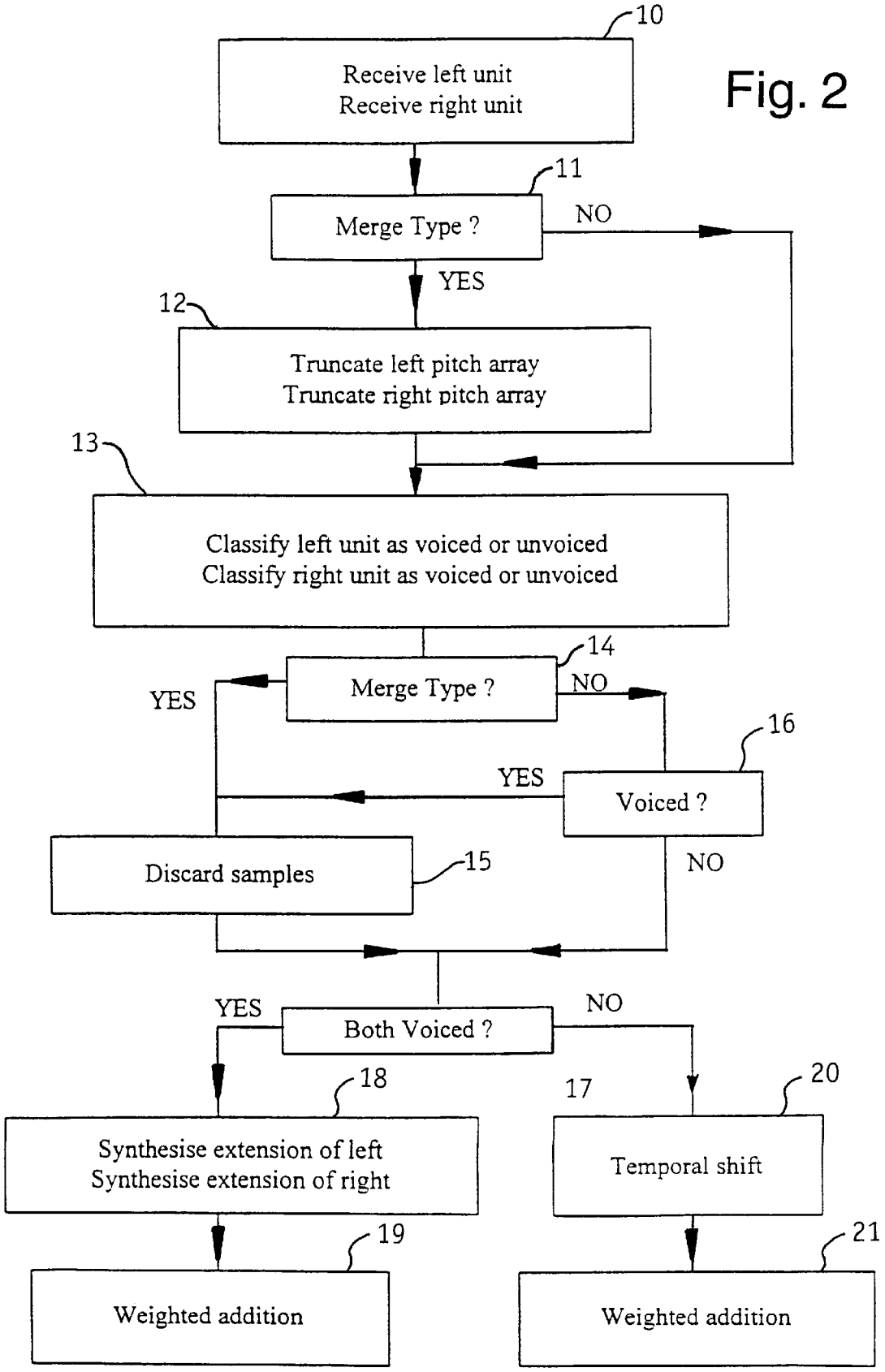
FIG. 2 is a flowchart illustrating the operation of the joining unit 5 of the apparatus of FIG. 1.

The units are then to be joined together, at 5. A flowchart for the operation of this device is shown in FIG. 2. In this description a unit and the unit which follows it are referred to as the left unit and right unit respectively. Where the units overlap—i.e. when the last phoneme of the left unit and the first phoneme of the right unit are to represent the same sound and form only a single phoneme in the final output—it is necessary to discard the redundant information, prior to making a "merge" type join; otherwise an "abut" type join is appropriate.

Figure 3:
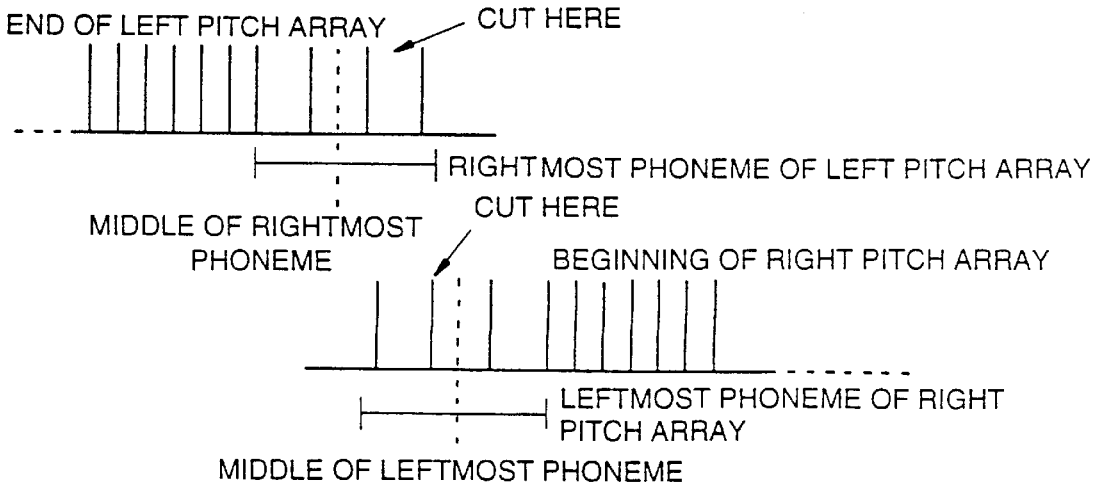
FIG. 3 to 9 are waveform diagrams illustrating the operation of the joining unit 5.

In step 10 of FIG. 2, the units are received, and according to the type of merge (step 11) truncation is or is not necessary. In step 12, the corresponding pitch arrays are truncated; in the array corresponding to the left unit, the array is cut after the first pitchmark to the right of the mid-point of the last phoneme so that all but one of the pitchmarks after the mid-point are deleted whilst in the array for the right unit, the array is cut before the last pitchmark to the left of the midpoint of the first phoneme so that all but one of the pitchmarks before the mid point are deleted. This is illustrated in FIG. 3.

Before proceeding further, the phonemes on each side of the join need to be classified as voiced or non-voiced, based on the presence and position of the pitchmarks in each phoneme. Note that this takes place (in step 13) after the "pitch cutting" stage, so the voicing decision reflects the status of each phoneme after the possible removal of some pitchmarks. A phoneme is classified as voiced if:

1. the corresponding part of the pitch array contains two or more pitchmarks; and
2. the time difference between the two pitchmarks nearest the join is less than a threshold value; and 3a. for a merge type join, the time difference between the pitchmark nearest the join and the midpoint of the phoneme is less than a threshold value;

3b. for an abut type join, the time difference between the pitchmark nearest the join and the end of the left unit (or the beginning of the right unit) is less than a threshold value.

Otherwise it is classified as unvoiced.

Rules 3*a* and 3*b* are designed to prevent excessive loss of speech samples in the next stage.

In the case of a merge type join (step 14), speech samples are discarded (step 15) from voiced phonemes as follows:

Left unit, last phoneme—discard all samples following the last pitchmark

Right unit, first phoneme—discard all samples before the first pitchmark;

and from unvoiced phonemes by discarding all samples to the right or left of the midpoint of the phoneme (for left and right units respectively).

In the case of an abut type join (steps 16, 15), the unvoiced phonemes have no samples removed whilst the voiced phonemes are usually treated in the same way as for the merge case, though fewer samples will be lost as no pitchmarks will have been deleted. In the event that this would cause loss of an excessive number of samples (e.g. more than 20 ms) then no samples are removed and the phoneme is marked to be treated as unvoiced in further processing.

Figure 4:
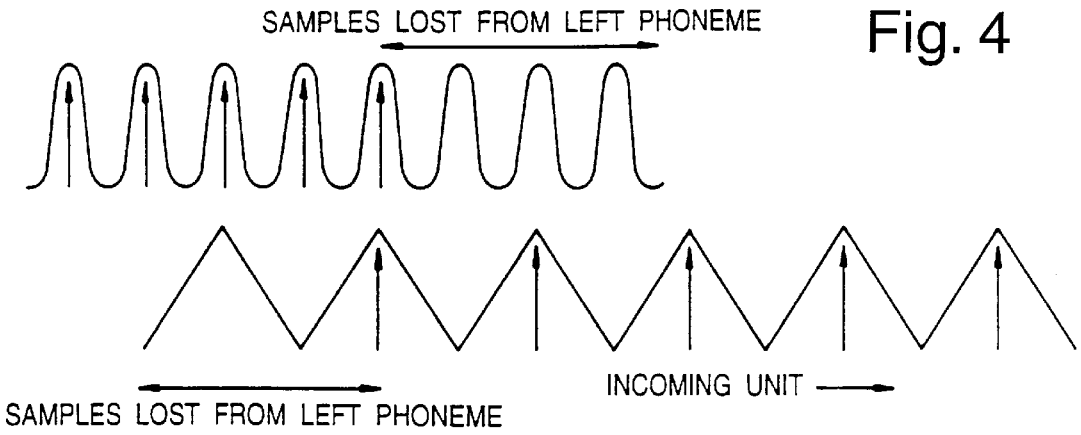

The removal of samples from voiced phonemes is illustrated in FIG. 4. The pitchmark positions are represented by arrows. Note that the waveforms shown are for illustration only and are not typical of real speech waveforms.

The procedure to be used for joining two phonemes is an overlap-add process. However a different procedure is used according to whether (step 17) both phonemes are voiced (a voiced join) or one or both are unvoiced (unvoiced join).

Figure 5:
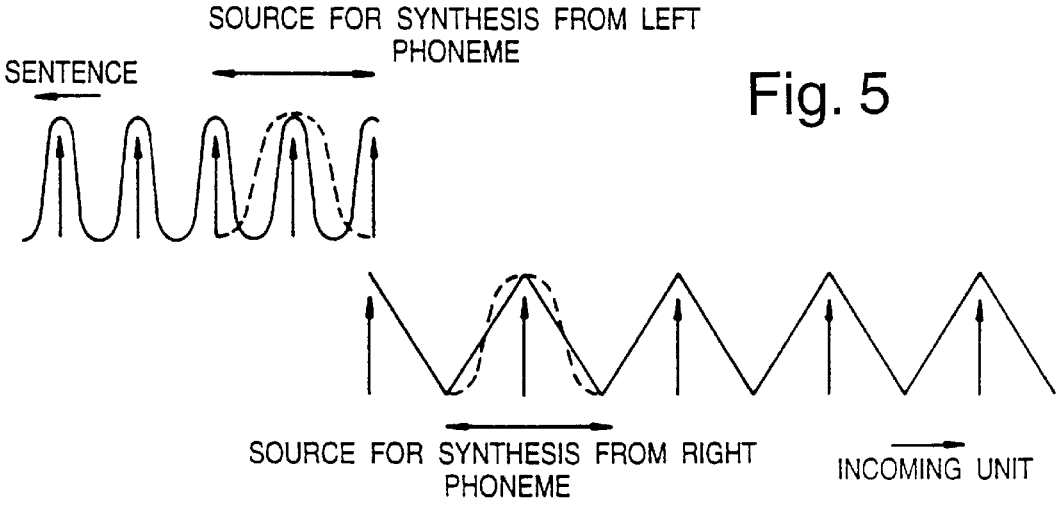
Figure 6:
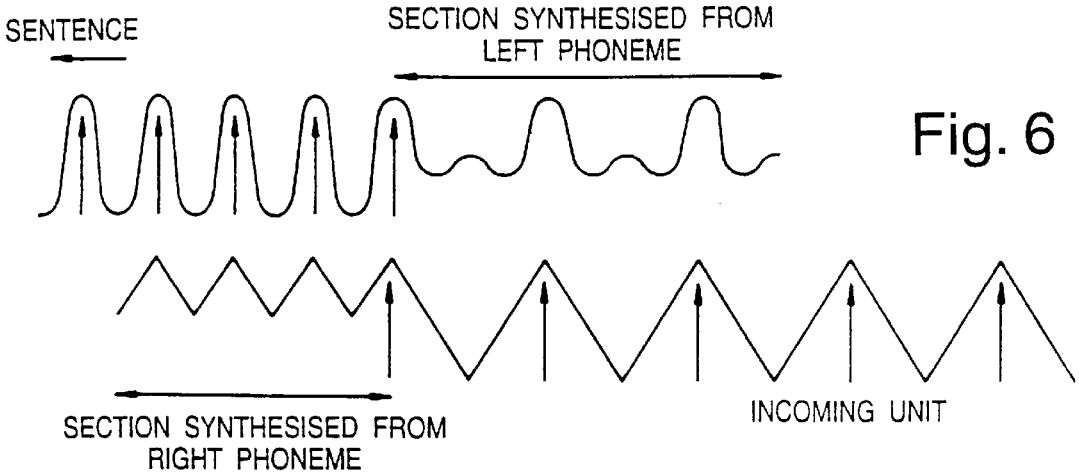
Figure 7:
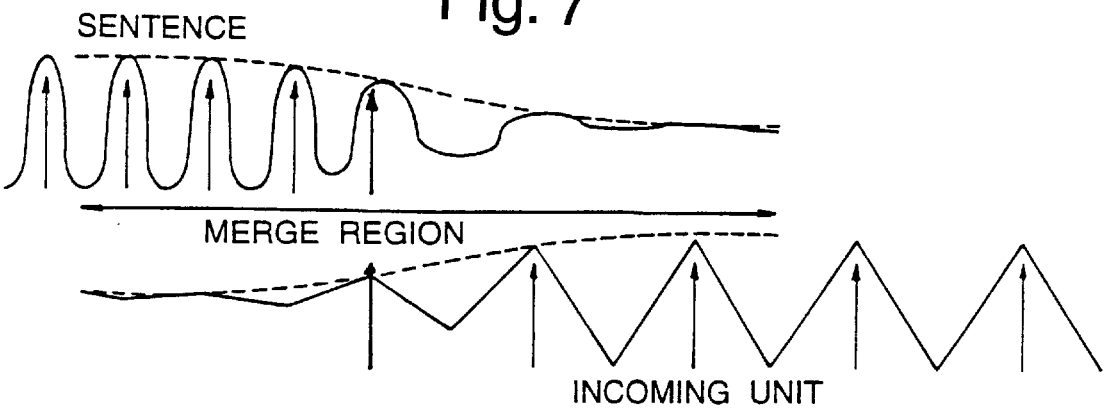
Figure 8:
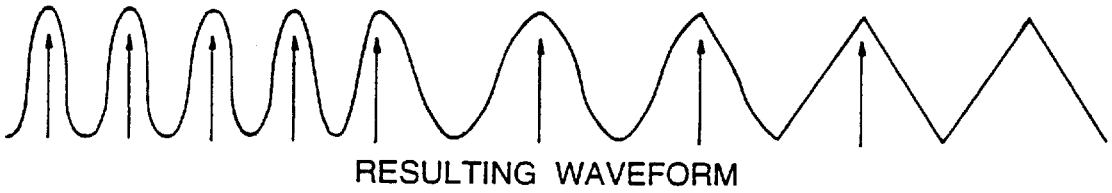

The voiced join (step 18) will be described first. This entails the following basic steps: the synthesis of an extension of the phoneme by copying portions of its existing waveform but with a pitch period corresponding to the other phoneme to which it is to be joined. This creates (or, in the case of a merge type join, recreates) an overlap region with, however, matching pitchmarks. The samples are then subjected to a weighted addition (step 19) to create a smooth transition across the join. The overlap may be created by extension of the left phoneme, or of the right phoneme, but the preferred method is to extend both the left and the right phonemes, as described below. In more detail:

1. a segment of the existing waveform is selected for the synthesis, using a Hanning window. The window length is chosen by looking at the last two pitch periods in the left unit and the first two pitch periods in the right unit to find the smallest of these four values. The window width—for use on both sides of the join—is set to be twice this.
2. the source samples for the window period, centred on the penultimate pitchmark of the left unit or the second of the right unit, are extracted and multiplied by the Hanning window function, as illustrated in FIG. 5. Shifted versions, at positions synchronous with the other phoneme's pitchmarks, are added to produce the synthesised waveform extension. This is illustrated in FIG. 6. The last pitch period of the left unit is multiplied by half the window function and then the shifted, windowed segments are overlap added at the last original pitchmark position, and successive pitchmark positions of the right unit. A similar process takes place for the right unit.
3. the resulting overlapping phonemes are then merged; each is multiplied by a half Hanning widow of length equal to the total length of the two synthesised sections as depicted in FIG. 7, and the two are added together (with the last pitchmark of the left unit aligned with the first pitchmark of the right); the resulting waveform should then show a smooth transition from the left phoneme's waveform to that of the right, as illustrated in FIG. 8.
4. the number of pitch periods of overlap for the synthesis and merge process is determined as follows. The overlap extends into the time of the other phoneme until one of the following conditions occurs
   (a) the phoneme boundary is reached;
   (b) the pitch period exceeds a defined maximum;
   (c) the overlap reaches a defined maximum (e.g. 5 pitch periods).

If however condition (a) would result in the number of pitch periods falling below a defined minimum (e.g. 3) it may be relaxed to allow one extra pitch period.

Figure 9:
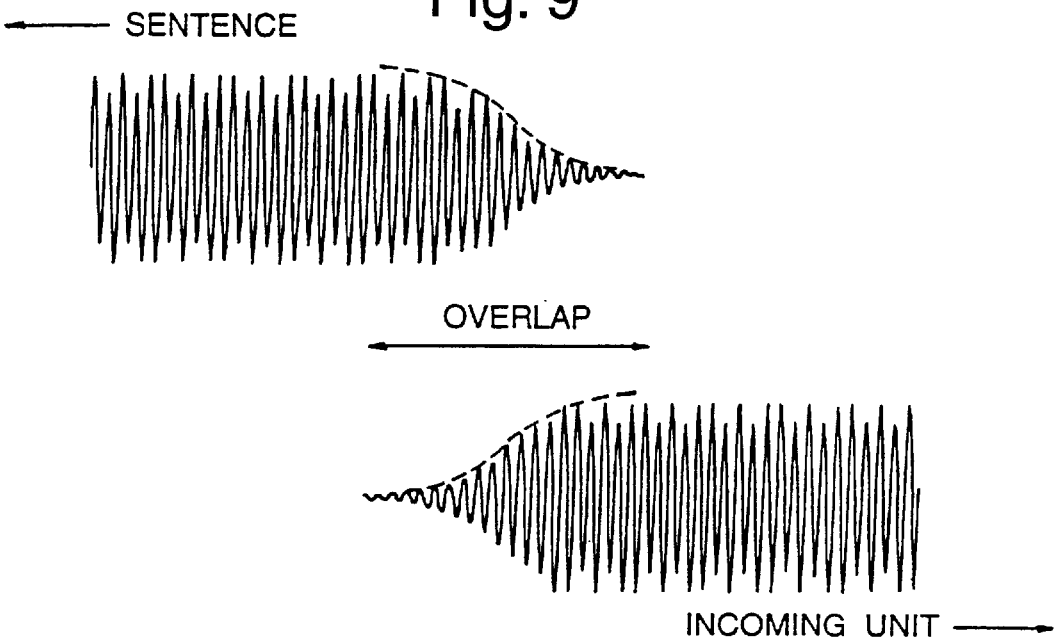

An unvoiced join is performed, at step 20, simply by shifting the two units temporally to create an overlap, and using a Hanning weighted overlap-add, as shown in step 21 and in FIG. 9. The overlap duration chosen is, if one of the phonemes is voiced, the duration of the voiced pitch period at the join, or if they are both unvoiced, a fixed value [typically 5 ms]. The overlap (for abut) should however not exceed half the length of the shorter of the two phonemes. It should not exceed half the remaining length if they have been cut for merging. Pitchmarks in the overlap region are discarded. For an abut type join, the boundary between the two phonemes is considered, for the purposes of later processing, to lie at the mid-point of the overlap region.

Of course, this method of shifting to create the overlap shortens the duration of the speech. In the case of the merge join, this can be avoided by "cutting" when discarding samples not at the midpoint but slightly to one side so that when the phonemes have their (original) mid-points aligned an overlap results.

The method described produces good results; however the phasing between the pitchmarks and the stored speech waveforms may—depending on how the former were generated—vary. Thus, although pitch marks are synchronised at the join this does not guarantee a continuous waveform across the join. Thus it is preferred that the samples of the right unit are shifted (if necessary) relative to its pitchmarks by an amount chosen so as to maximise the cross-correlation between the two units in the overlap region. This may be performed by computing the cross-correlation between the two waveforms in the overlap region with different trial shifts (e.g.±3 ms in steps of 125 $\mu$s). Once this has been done, the synthesis for the extension of the right unit should be repeated.

After joining, an overall pitch adjustment may be made, in conventional manner, as shown at 6 in FIG. 1.

The joining unit 5 may be realised in practice by a digital processing unit and a store containing a sequence of program instructions to implement the above-described steps.

What is claimed is:

1. A method of speech synthesis comprising the steps of:

retrieving a first sequence of digital samples corresponding to a first desired speech waveform and first pitch data defining excitation instants of the waveform corresponding to glottal closures;

retrieving a second sequence of digital samples corresponding to a second desired speech waveform and second pitch data defining excitation instants of the second waveform corresponding to glottal closures;

forming an overlap region by:

a) synthesising from at least one sequence an extension sequence, the extension sequence comprising a segment of said at least one sequence, which segment represents at least a substantial part of a pitch period of said first waveform that is expanded or compressed with respect to time so as to have synthesized excitation instants synchronous with respective excitation instants of the other sequence; and b) forming for the overlap region weighted sums of samples of the first and/or second sequence(s) and samples of the synthesized extension sequence(s).

2. A method as in claim 1, wherein said synthesis step comprise:

extracting from the relevant sequence a subsequence of samples, multiplying the subsequence by a window function and repeatedly adding the subsequences with shifts corresponding to the excitation instants of the other one of the first and second sequences.

3. A method of speech synthesis comprising the steps of:

retrieving a first sequence of digital samples corresponding to a first desired speech waveform and first pitch data defining excitation instants of the waveform corresponding to glottal closures;

retrieving a second sequence of digital samples corresponding to a second desired speech waveform and second pitch data defining excitation instants of the second waveform corresponding to glottal closures;

forming an overlap region by;

a) synthesising from the first sequence a first extension sequence at the end of the first sequence, the first extension sequence comprising a segment of said first sequence, which segment represents at least a substantial part of a pitch period of said first waveform that is expanded or compressed with respect to time so as to have synthesized excitation instants synchronous with respective excitation instants of the second sequence;

b) synthesising from the second sequence a second extension sequence at the beginning of the second sequence, the second extension sequence comprising a segment of said second sequence, which segment represents at least a substantial part of a pitch period of said second waveform that is expanded or compressed with respect to time so as to have synthesized excitation instants synchronous with respective excitation instants of the first sequence; and c) forming for the overlap region weighted sums of samples of the first sequence and samples of the second extension sequence and weighted sums of samples of the second sequence and samples of the first extension sequence.

4. A method as in claim 3 wherein:

the first sequence has a portion at the end thereof corresponding to a particular sound and the second sequence has a portion at the beginning thereof corresponding to the same sound, and prior to the synthesis, samples are removed from the end of the said portion of the first waveform and from the beginning of the said portion of the second waveform.

5. A method as in claim 3 including the steps of, prior to forming the weighted sums:

comparing, over the overlap region, the first sequence and its extension with the second sequence and its extension to derive a shift value which maximises the correlation therebetween, adjusting the second pitch data by the determined shift amount and repeating the synthesis of the second extension sequence.

6. A method of speech synthesis comprising the steps of:

retrieving a first sequence of digital samples corresponding to a first desired speech waveform and first pitch data defining excitation instants of the waveform;

retrieving a second sequence of digital samples corresponding to a second desired speech waveform and second pitch data defining excitation instants of the second waveform;

forming an overlap region by synthesizing from at least one sequence an extension sequence, the extension sequences being pitch adjusted to be synchronous with the excitation instants of the respective other sequence;

forming for the overlap region weighted sums of samples of the first and/or second sequence(s) and samples of the extension sequence(s);

each synthesis step including extracting from the relevant sequence a subsequence of samples, multiplying the subsequence by a window function and repeatedly adding the subsequences with shifts corresponding to the excitation instants of the other one of the first and second sequences; and wherein said window function is centred on the penultimate excitation instant of the first sequence and on the second excitation instant of the second sequence and has a width equal to twice the minimum of selected pitch periods of the first and second sequences, where a pitch period is defined as the interval between excitation instants.

7. An apparatus for speech synthesis comprising:

means storing original sequences of digital samples corresponding to portions of speech waveform and pitch data defining excitation instants of those waveforms;

control means controllable to retrieve from the store means sequences of digital samples corresponding to desired portions of speech waveform and the corresponding pitch data defining excitation instants of the waveform representing glottal closures;

means for joining the retrieved sequences, the joining means being arranged in operation (a) to synthesise from at least the first of a pair of retrieved sequences an extension sequence to extend that sequence into an overlap region with the other sequence of the pair, the extension sequence comprising a segment of said first sequence that is expanded or compressed with respect to time so as to have synthesized excitation instants synchronous with respective excitation instants of that other sequence, said segment representing at least a substantial part of a pitch period of said first waveform; and (b) to form for the overlap region weighted sum of samples of the original sequence(s) and samples of the extension sequence(s).

8. A method of speech synthesis which joins together first and second segments of recorded speech samples, said method comprising the steps of:

forming an overlap region between oppositely situated ends of said first and second segments in the time domain including synthesizing a portion of at least one of said segments therein so as to have an adjusted local pitch that has excitation instants representing glottal closures that are coincident with the excitation instants of the overlapped portion of the other segment said overlap region comprising a time expanded or compressed portion of one of said segments which portion represents at least a substantial part of a pitch period; and forming a weighted sum of the resulting samples in the overlap region.

9. Apparatus for speech synthesis which joins together first and second segments of recorded speech samples, said apparatus comprising:

means for forming an overlap region between oppositely situated ends of said first and second segments in the time domain including synthesizing a portion of at least one of said segments therein so as to have an adjusted local pitch that has excitation instants representing glottal closures that are coincident with the excitation instants of the overlapped portion of the other segment said overlap region a time expanded or compressed portion of one of said segments which portion represents at least a substantial part of a pitch period; and means for forming a weighted sum of the resulting samples in the overlap region.

10. A method of joining two sequences of digitized speech signals during speech synthesis, each sequence including successive digital samples of a speech waveform and data defining glottal closure speech excitation instants associated with particular ones of said samples, said method comprising:

i) forming an overlap region between the end of a first sequence and the beginning of a second sequence by synthesizing at least one extension sequence of said first and second sequences;

ii) said at least one extension sequence comprising digital samples of a substantial part of a pitch period of speech waveform derived from one of said first and second sequences but time shifted so as to compress or expand the extension sequence to define glottal closure instants that are time synchronous with the glottal closure instants of the other of said first and second sequences; and iii) forming for the overlapped region weighted sums of the digital signal samples therein.

11. Apparatus for joining two sequences of digitized speech signals during speech synthesis, each sequence including successive digital samples of a speech waveform and data defining glottal closure speech excitation instants associated with particular ones of said samples, said apparatus comprising:

means for forming an overlap region between the end of a first sequence and the beginning of a second sequence by synthesizing at least one extension sequence of said first and second sequences; said at least one extension sequence comprising digital samples of a substantial part of a pitch period of speech waveform derived from one of said first and second sequences but time shifted so as to compress or expand the extension sequence to define glottal closure instants that are time synchronous with the glottal closure instants of the other of said first and second sequences; and means for forming for the overlapped region weighted sums of the digital signal samples therein.

* * * * *